United States Patent [19]

Viré

[11] Patent Number: 4,601,804

[45] Date of Patent: Jul. 22, 1986

[54] CELL FOR ELECTROLYTIC PURIFICATION OF ALUMINUM

[75] Inventor: Sylvestre Viré, Neuhausen, Switzerland

[73] Assignee: Swiss Aluminium Ltd., Chippis, Switzerland

[21] Appl. No.: 630,289

[22] Filed: Jul. 12, 1984

[30] Foreign Application Priority Data

Jul. 27, 1983 [CH] Switzerland ..... 4131/83

[51] Int. Cl.[4] ..... C25C 3/08; C25C 3/18; C25C 3/22; C25C 3/24

[52] U.S. Cl. ..... 204/244; 204/247; 204/268; 204/295

[58] Field of Search ..... 204/67, 243 R–247, 204/268, 295

[56] References Cited

U.S. PATENT DOCUMENTS 4,118,292 10/1978 Fray et al. ..... 204/67
4,405,415 9/1983 Dewing et al. ..... 204/67
4,411,747 10/1983 Dawless et al. ..... 204/67

*Primary Examiner*—Donald R. Valentine
*Attorney, Agent, or Firm*—Bachman & LaPointe

[57] ABSTRACT

The thermally insulated cell comprises: a trough with a steel shell which is surrounded by an outer wall, is lined with a material which is resistant to electrolyte and high temperatures, and is closed by a lid; an electrolyte based on alkali chlorides; segregation wells for the addition of aluminum which is to be purified and for the precipitation of impurity crystals; a supply means which is used to feed-in electrolyte material and is also conceived as a waste gas extractor; a collection and run-off system for the high purity aluminum. Provided in the interior of the cell are bipolar electrode units which are connected electrically in series and are arranged immersed in the electrolyte parallel to the end electrodes. The electrode units comprise graphite frames closed and sealed off by a diaphragm plate, which can be wet by the electrolyte but not by the aluminum. The interpolar distance between the inner side of the diaphragm plate and the cathodic graphite frame is preferably 10–25 mm.

11 Claims, 6 Drawing Figures

CELL FOR ELECTROLYTIC PURIFICATION OF ALUMINUM

BACKGROUND OF INVENTION

The invention relates to a thermally insulated cell for the electrolytic purification of aluminum comprising a trough with a steel shell which is surrounded by an outer wall, is lined with a material which can resist high temperatures and electrolyte and is closed off by a lid; an electrolyte based on alkali chlorides; segregation wells for the addition of the aluminum which is to be purified and for the precipitation of crystalline components; a supply means which is used to feed-in electrolyte material and is also conceived as a waste gas extractor; and a collection and run-off system for the high purity aluminum.

The electrolytic purification of aluminum is based on the fact that components which are less noble than aluminum (e.g. sodium, potassium, lithium, magnesium, calcium) and are present in the alloy to be treated dissolve anodically in the aluminum but cannot be precipitated at the cathode and the components which are more noble than aluminum do not dissolve anodically and thus form crystals and remain in the anode metal. The three layer cell for electrolytic purification of aluminum has been known since the start of this century and contains three molten layers. The lowest, heavy layer is normally an Al-Cu-Si-Fe alloy the surface of which is at the same time the anode. The electrolyte layer comprising fluorides and/or chlorides of alkali and alkaline earth metals. The purified aluminum which is the third uppermost layer, the lower surface of which forms the cathode.

By applying a direct current to that cell the aluminum is oxidized to trivalent aluminum ions. These ions move through the electrolyte to the cathode where they are again reduced to metallic aluminum.

By means of a segregation well which is operated at a temperature lower than the normally 700°-800° C. of the purification cell, impurities which crystallize out, in particular as intermetallic phases containing Al, Cu, Fe and Si, are removed.

The energy consumed in the conventional three layer purification cell is relatively high. Typical values for the cell voltage are ca. 5.5 V with a current yield of about 78-97%. This results in an energy consumption of appproximately 16-18 kwh/kg of purified aluminum.

From a physics standpoint two possible developments could lead to a reduction of the energy consumption:

(1) The use of electrolytes with higher electrical conductivity and/or (2) reducing the interpolar distance i.e. the thickness of the electrolyte layer.

The electrolyte layer, which is normally 10-15 mm thick in the conventional three layer process, can not be reduced at will without risking the possibility of mechanical contamination of the layer of purified aluminum by contact with the anodically polarized aluminum. Recently vessel-shaped or vertically displaceable diaphragms have been employed to help reduce the high energy consumption of the cell.

The object of the present invention is to develop for the electrolytic purification of aluminum, a cell which not only features low energy consumption but also high metallurgical efficiency and can be realized with low investment costs.

SUMMARY OF THE INVENTION

The foregoing object is achieved by way of the present invention wherein bipolar electrode units are provided connected electrically in series, immersed in the cell interior in the electrolyte where the said electrode unit has a graphite frame which is vessel-shaped and has an open face facing in the direction of the end graphite cathode and a flat surface facing the direction of the end graphite anode, a diaphragm plate which closes over and seals the opening in the graphite frame and which is wettable by molten electrolyte but not by aluminum, and has its open pore structure full of electrolyte, and a separate segregation well for feeding aluminum which is to be purified and for precipitating out impurity crystals. The said electrode units are arranged at a regular spacing, the interpolar distance between the inner side of the diaphragm plate and the cathodic graphite frame, parallel to each other and to the end graphite anode with the anodic current connection, and also to the end graphite cathode with the cathodic current connection, and such that the height of the volume for the aluminum which is to be purified, enclosed by the graphite frame and the diaphragm plate, is of such a dimension that when the said volume is full the static pressure is lower than the critical value to penetrate the porous diaphragm plate. In order that the diaphragm plate ensures the smallest possible voltage drop it must be made of a material which is readily wet by the electrolyte, and the aluminum ions must be able to migrate from the interior to the surface of the diaphragm with the smallest possible voltage drop. On the other hand the diaphragm plate must be absolutely impermeable to the metallic aluminum, that is non-wettable.

If the aluminum which is to be purified is put into the space in the electrode unit, between the graphite wall and the diaphragm plate, then a static pressure is created which increases with the level of filling. At a critical value this pressure will become so large that the molten aluminum will be forced through the open pore channels in the diaphragm plate even though the material of the diaphragm plate is not wet by it.

The cross-sectional area of electrode units employed on an industrial scale are for example 2×2 m. If these are mounted in a vertical or almost vertical position it is not possible to make an open pore structure which is sufficiently fine to prevent the non-purified aluminum from being pressed through the diaphragm plate. The electrode units are therefore subdivided by graphite dividing walls, preferably with a square or rectangular network, with 5-30 cm along sidewalls. Each of these sub-elements created by the dividing walls is provided with a separate diaphragm plate and facility for feeding it to the aluminum which is to be purified.

The sub-elements of an electrode unit can, however, also be in the form of separate units which are held together wall-to-wall in a graphite enclosure. Such units have the advantage that individual sub-elements can be exchanged. Of course here too each sub-element has its own porous diaphragm plate and means for feeding-in the aluminum which is to be purified.

Window-shaped openings can be provided in the dividing walls or sub-element walls that are held together. As a result the molten aluminum circulates not only in a sub-element but also between neighboring chambers. The dimensions of the openings are however to be kept to such a small size that the static pressure on the porous diaphragm plate remains below the critical pressure discussed above. In the conception of the cell therefore care must be taken that the thickness of the diaphragm plate, its material, the density of the electrolyte, the width of the open pore channels, the dimensions of the sub-elements and the window-shaped openings must be selected in agreement with each other such that the aluminum which is to be purified cannot penetrate the pores in the diaphragm plate.

Materials which are preferably employed for the open-pore diaphragm plate are aluminum oxide, magnesium oxide, oxy-nitrides of silicon or oxy-nitrides of aluminum and silicon. The porosity preferably lies between 60 and 70%. In general the ceramic filters of U.S. Pat. Nos. 3,947,363, 3,962,081, 3,425,918 and 4,024,056 for cleaning molten metal can also be employed as porous diaphragm plates if they are dimensioned in accordance with the graphite frames. In practice 3–15 mm thick diaphragm plates are employed for the electrolytic purification of aluminum.

The electrode units are installed in thermally insulated cells which have a steel shell surrounded by an outer wall and lined with magnesite bricks or nitride bearing refractory material. The electrode units form one or more rows inside the cell. They are all arranged parallel to the end anode and the end cathode. The interpolar distance between the inner side of the anodic diaphragm plate and the outside of the cathodic graphite frame is preferably 10–25 mm.

Depending on the arrangement of the electrode units one differentiates between two types of bipolar cells for the electrolytic purification of aluminum:

(1) A horizontal arrangement in which the electrode units are installed vertical or almost vertical, (2) a vertical arrangement with horizontal or slightly inclined electrode units.

The space around the electrode units is filled with electrolyte which is molten at the operating temperature of the cell. The top level of the electrolyte in the cell is subject to almost no fluctuation and lies above the uppermost part of the electrode units. The electrolyte is preferably made up of a mixture of lithium chloride, potassium chloride and sodium chloride; it is however particularly favorable if a small amount of alkali fluoride is added to the mixture. All of these electrolyte compositions are known and are obtainable from technical literature.

The aluminum which is to be purified is fed to the cell via segregation wells which also serve the purpose of precipitating out impurity element crystals in the form of intermetallic compounds of aluminum, iron, silicon, titanium etc. As a rule these crystals do not contain copper as is the case with the three layer electrolytic process. As the aluminum which has to be purified is separated from the high purity aluminum by the diaphram plate, it is not necessary to check or increase the density of the anodic metal. Hence the density of the electrolyte is not important, this simplifies the selection of a material which is a good electrical conductor.

The direct electric current is conducted to the end anode by means of at least one anode bar, conducted in a bipolar manner through the electrode units and the electrolyte, through the cell to the end cathode where the direct current is again led off via at least one cathodic electrode bar. In principle the electrolytic process operating in a bipolar cell is the same as in the three layer process where the aluminum is dissolved out of the contaminated metal, made to migrate through the electrolyte (here, through the electrolyte in the open pore channels of the diaphragm plate and the electrolyte between the electrode units) and to precipitate on the cathode. In the present case the cathodic surface is the backwall of the graphite frame. Using bipolar cells the power and investment cost can be reduced considerably below those in the case of the three layer cells.

The precipitated aluminum flows from the cathodic graphite frame into the tapping channel which is situated in the electrically insulated part of the cell floor from which the high purity aluminum can then be removed by means of a suction pipe.

BRIEF DESCRIPTION OF THE DRAWINGS

The invention is explained in greater detail hereinbelow with the help of the schematic drawings wherein.

DETAILED DESCRIPTION

Figure 1:
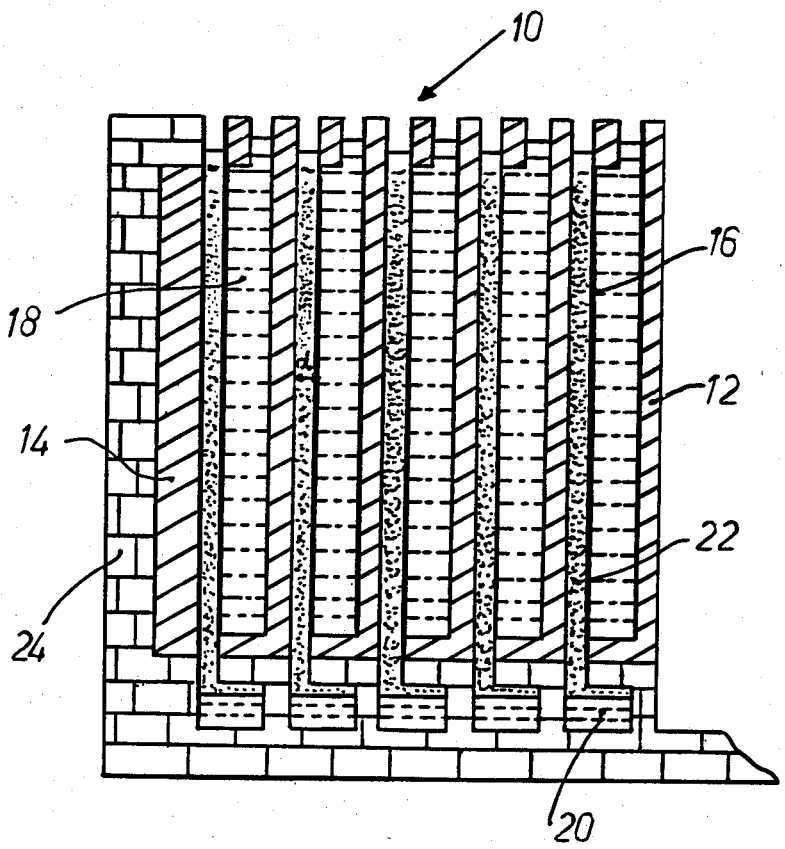
FIG. 1: Is a vertical cross section through the cathodic end of a bipolar cell for electrolytic purification of aluminum.

FIG. 1 shows a bipolar cell featuring five vertical electrode units 10 with a graphite frame 12 the recess over the whole surface of which is closed off, at the side towards the graphite cathode 14 at the end, by a porous diaphragm plate 16. The vessel-shaped space in the electrode units 10 is filled with the molten aluminum 18 which is to be purified and is at the operating temperature of 700°–800° C. Run-off channels 20 for the purified aluminum are provided recessed in the cell lining of refractory material. The electrolyte 22 is present between the electrode units and above the purified aluminum.

If the direct electric current is conducted to the end anode, not shown here, then this flows through the electrode unit to the cathode from which the electric circuit is completed by a cathode electrode bar, also not shown here. During operation of the cell, the side of the impure aluminum which faces the diaphragm plate functions as the anode while the back wall of the next electrode unit, in the direction towards the cathode at the end, functions as the cathode. All of the electrode units in the cell therefore function in a bipolar manner. The interpolar distance d is the shortest distance between the aluminum which is to be purified and the back wall of the next graphite frame, in other words the thickness of the porous diaphragm plate plus the thickness of the electrolyte layer.

Figure 2:
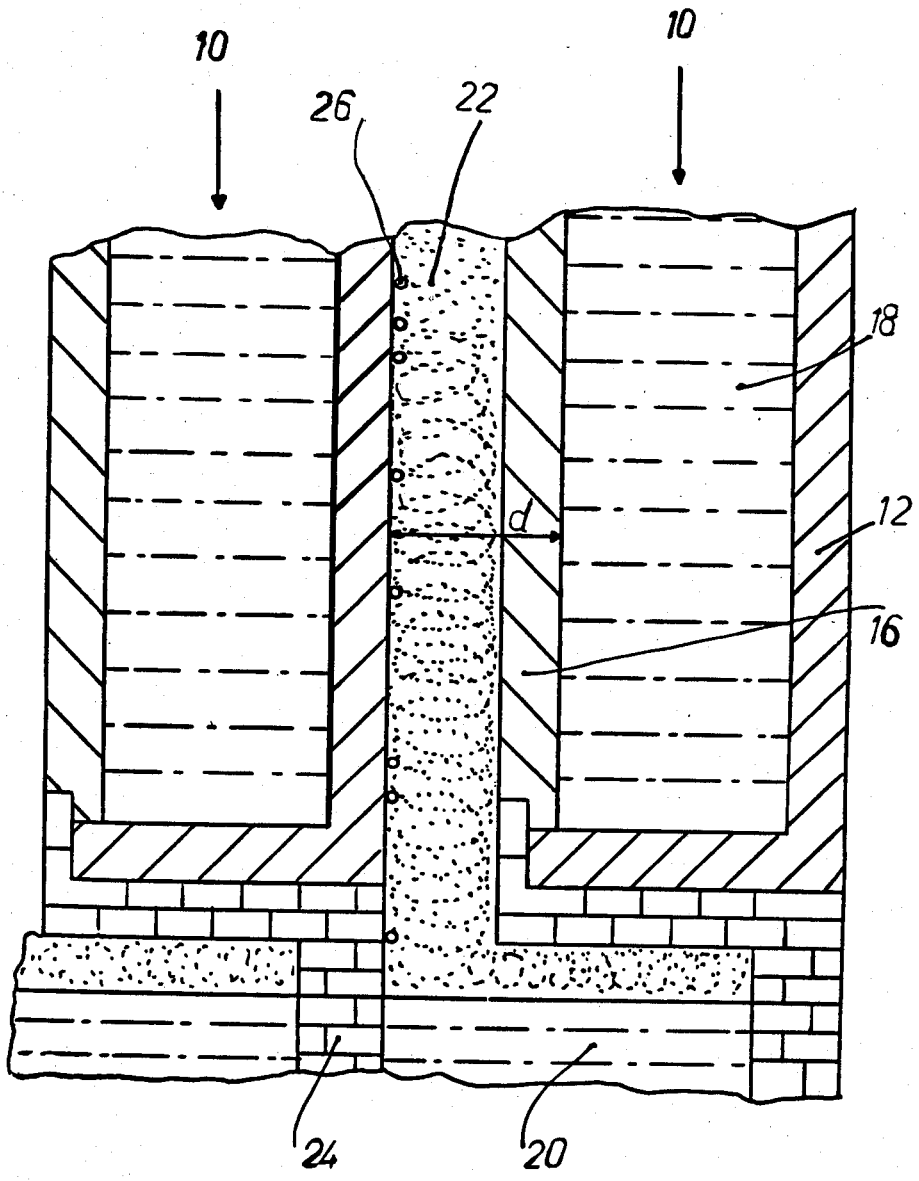
FIG. 2: Is a detail from the lower region of FIG. 1.

Shown in FIG. 2 is the newly precipitated aluminum 26 which forms in droplets along the cathodic back wall of the graphite frame 12, runs down this and collects in the run-off channel 20. Also shown here is the horizontal interpolar distance d which extends across the electrolyte 22 and the porous diaphragm 16. For simplicity here the walls which divide up the interior of the electrode unit have been omitted.

Figure 3:
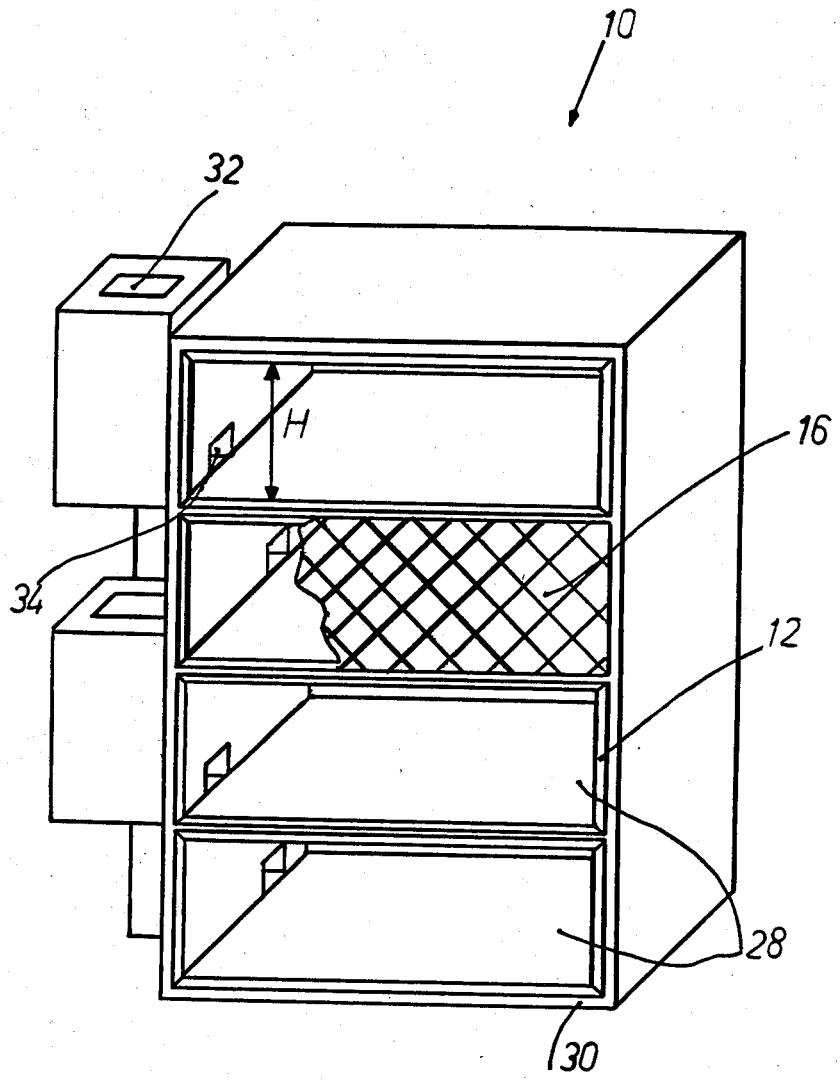
FIG. 3: Is a perspective view of an electrode unit which can be operated vertically.

The vertical electrode unit 10 shown in FIG. 3 comprises four sub-elements 28 which are held together by a graphite enclosure 30. Each sub-element 28 has a graphite frame 12 with an opening over one end which is closed off by a porous diaphragm plate 16. This diaphragm plate 16 is usefully inserted with electrolyte material already in the open pore structure.

Each sub-element 28 has its own segregation well 32 which connects up to the interior of the sub-element via an opening 34. The segregation wells, which are for precipitating out crystals of impurity elements and for introducing to the cell aluminum which is to be purified, are also displaced in the horizontal direction to make the servicing of them easier. The height H of a sub-element may only be so large that the static pressure required for aluminum to penetrate the open pore structure is not reached. In the present case H is about 30 cm.

Figure 4:
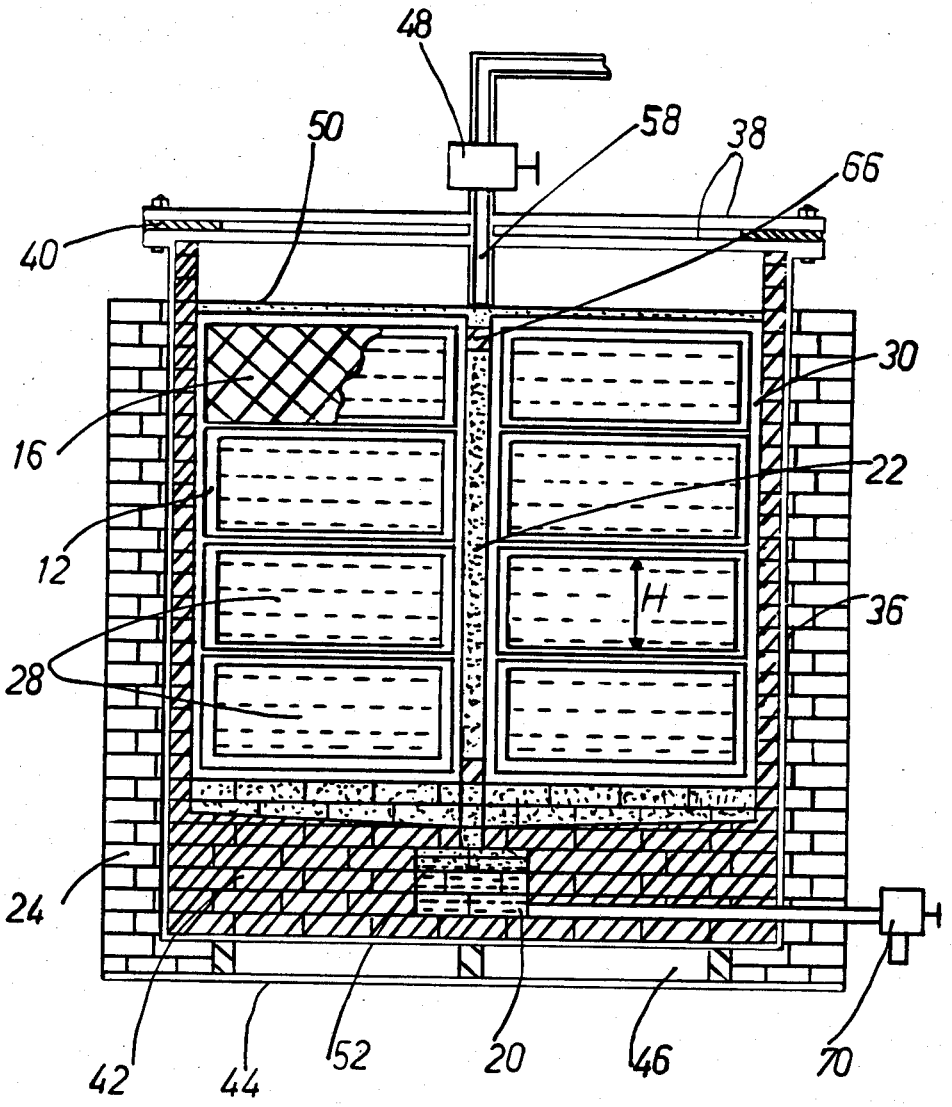
FIG. 4: Is a vertical cross section through a bipolar cell having two rows of vertical electrode units.

The electrode units 10 shown in FIG. 3 are arranged in two rows in the cell, as shown in FIG. 4. In the surrounding cell wall 24 is a steel shell 36 which is closed off by a corrosion-resistant, double-walled lid 38 of steel with intervening seal 40. The steel shell is lined on the inside with magnesite bricks 42 which are able to withstand both the molten electrolyte and the molten aluminum. A base plate 44 of steel supports the whole cell and by virtue of an air space 46 provides additional insulation.

The lid 38 on the steel shell 36 is penetrated by a pipe 58 which is well insulated from the lid 38 and, by allowing material to be added, enables the level 50 of the electrolyte 22 to be kept above the electrode units 10 at all times and, at the same time, permits any gases that form to be conducted away. A special facility 48 is connected to the cell during its operation in order to draw off any gases which may form.

A siphon 70 allows the purified aluminum to be sucked out of the run-off channel 20 one or more times per day. The level 52 of the purified aluminum on the other hand must always lie below the electrode units 10.

Figure 5:
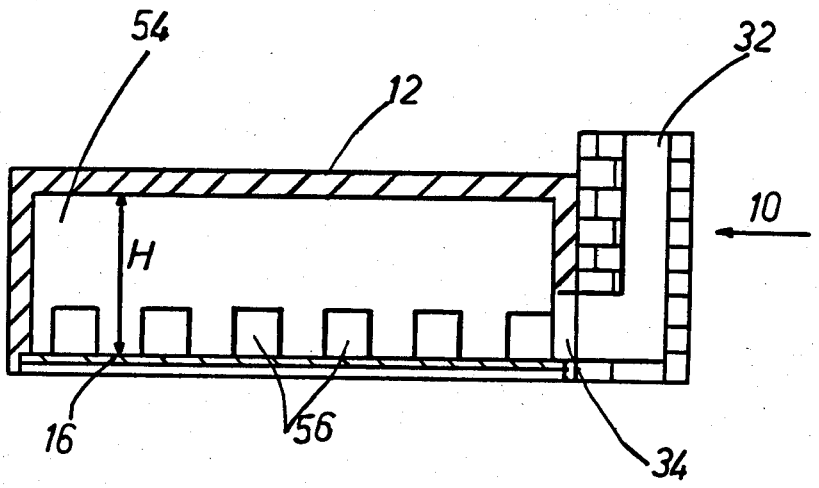
FIG. 5: Is a vertical cross section through an electrode unit which can be employed in the horizontal position.

The electrode unit 10 shown in FIG. 5 is essentially the same as that in FIG. 3, but is intended for horizontal installation in a cell. The segregation well 32 and its opening 34 are arranged in accordance with this. The vertical cross section through the unit 10 runs through a graphite dividing wall 54 which has at its bottom window-shaped openings 56 that permit the impure aluminum to circulate between neighboring sub-elements. The height of 25 cm is selected such that the static pressure of the impure aluminum is not sufficient to force the aluminum into the pores in the diaphragm 16.

Figure 6:
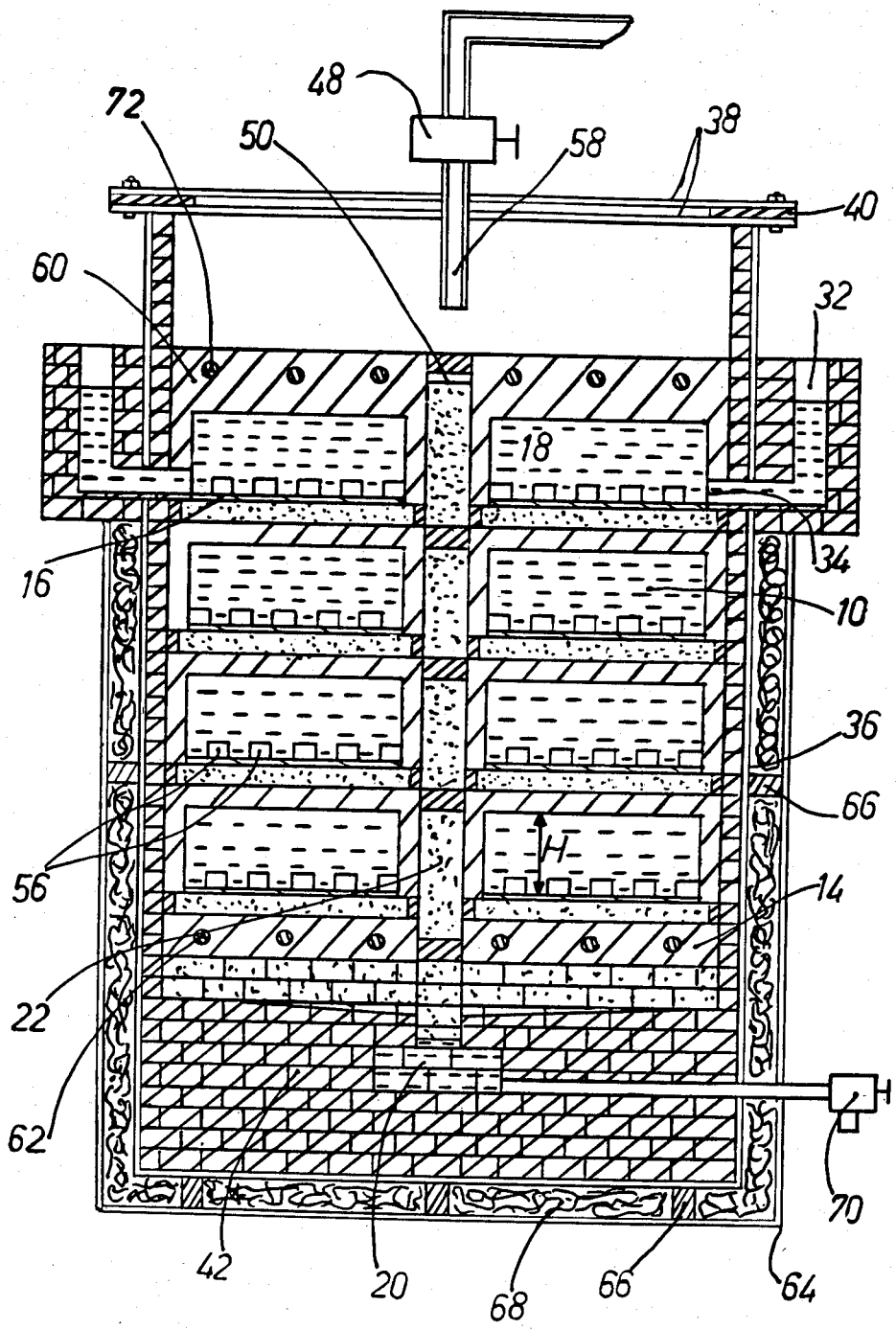
FIG. 6: Is a bipolar cell with horizontal electrode units.

The electrode units 10 shown in FIG. 5 are arranged horizontally in a cell of the kind in FIG. 6 with the diaphragm plates 16 facing downwards. The graphite end cathode 14 at the bottom features three cathodic electrode bars 62, while the uppermost graphite end anode 60 features three anodic electrode bars 72.

Apart from the inner steel shell 36, the cell features an outer steel shell 64 with single refractory bricks acting as spacers 66. The space between the steel shells is filled with a light insulating material 68 such as for example mineral wool.

It is to be understood that the invention is not limited to the illustrations described and shown herein, which are deemed to be merely illustrative of the best modes of carrying out the invention, and which are susceptible of modification of form, size, arrangement of parts and details of operations. The invention rather is intended to encompass all such modifications which are within its spirit and scope as defined by the claims.

What is claimed is:

1. A thermally insulated cell for the electrolytic purification of aluminum, comprising a trough having a steel shell surrounded by an outer wall, said trough being provided with a lining of high temperature electrolyte resistant material; a lid for closing off said trough; segregation wells for feeding impure aluminum to the cell and precipitating out crystals of impurity elements; means for supplying an electrolyte material having alkali chlorides as its base to said trough and also for withdrawing waste gases therefrom; and a collection and run-off system for collecting the purified aluminum, wherein a plurality of bipolar electrode units are immersed in the cell interior in the electrolyte where the said electrode units are connected in series and each have (1) a graphite frame which is vessel-shaped and has an open face facing in the direction of the end of a graphite cathode and a flat surface facing in the direction of the end of a graphite anode;

(2) a porous diaphragm plate which closes over and seals the opening in the graphite frame and which is wettable by the molten electrolyte but not by aluminum, and has its porous structure full of the electrolyte; and (3) a separate segregation well for feeding aluminum which is to be purified and for precipitating out impurity crystals; the said plurality of electrode units being arranged at a regular spacing (d), the interpolar distance between the inner side of the diaphragm plate and the cathodic frame, parallel to each other and to the end graphite anode having an anodic current connection, and also to the end graphite cathode having a cathodic current connection and such that the height (H) of the volume for the aluminum which is to be purified, enclosed by the graphite frame and diaphragm plate, is of such a dimension that when the said volume is full the static pressure is lower than the critical value to penetrate the porous diaphragm plate.

2. A cell according to claim 1 wherein the plurality of electrode units are subdivided into at least three sub-elements by graphite dividing walls such that each sub-element has a separate diaphragm plate and a separate segregation well.

3. A cell according to claim 2 wherein the sub-elements are in the form of separate units and are held together in a graphite frame.

4. A cell according to claim 2 wherein the dividing walls feature window-shaped openings.

5. A cell according to claim 1 wherein the porosity of the porous diaphragm plate is from about 60–90%.

6. A cell according to claim 1 wherein the porous diaphragm plate is made of a material selected from the group consisting of aluminum oxide, magnesium oxide, oxy-nitrides of silicon, oxy-nitrides of aluminum and silicon and mixtures thereof.

7. A cell according to claim 1 wherein the interpolar distance (d) between the inner side of the anodic diaphragm plate and the cathodic graphite frame is from about 10–25 mm.

8. A cell according to claim 1 wherein the plurality of electrode units are arranged next to each other substantially vertically.

9. A cell according to claim 1 wherein the plurality of electrode units are arranged next to each other substantially horizontally.

10. A cell according to claim 1 wherein the electrolyte is made up of a mixture of lithium chloride, potassium chloride and sodium chloride.

11. A cell according to claim 10 wherein the electrolyte contains an addition of alkali fluoride.

* * * * *